United States Patent [19]

Audeh

[11] 4,419,217

[45] Dec. 6, 1983

[54] PROCESS FOR IMPROVING THE YIELD OF SHALE OIL

[75] Inventor: Costandi A. Audeh, Princeton, N.J.

[73] Assignee: Mobil Oil Corporation, New York, N.Y.

[21] Appl. No.: 467,415

[22] Filed: Feb. 17, 1983

[51] Int. Cl.[3] ..... C10G 1/00
[52] U.S. Cl. ..... 208/11 R; 208/11 LE
[58] Field of Search ..... 208/11 LE, 11 R

[56] References Cited

U.S. PATENT DOCUMENTS 4,046,668 9/1977 Farcasiu et al. ..... 208/11 LE
4,238,315 12/1980 Patzer ..... 208/11 LE

*Primary Examiner*—Delbert E. Gantz
*Assistant Examiner*—Anthony McFarlane
*Attorney, Agent, or Firm*—Alexander J. McKillop; Michael G. Gilman; Howard M. Flournoy

[57] ABSTRACT

Spent shale is treated with a mixture of methanol and water at moderate temperatures whereupon the treating mixture is removed and the treated spent shale is retorted. This results in 20% additional oil yield.

4 Claims, No Drawings

PROCESS FOR IMPROVING THE YIELD OF SHALE OIL

BACKGROUND OF THE INVENTION

1. Field of the Invention

This invention is directed to a process whereby additional oil is obtained from previously spent shale, more specifically the process is directed to a means of treating spent shale with methanol and water to obtain improved yield of shale oil.

2. Description of the Prior Art

Spent shale disposal is a major concern in oil shale development because of the volume of material to be disposed of and the potentially harmful materials it contains. Depending on the oil yield from the shale, aboveground retorting could require as much as 18.5 tons of oil shale mined per cu. meter of oil produced. Although mining and crushing reduces the oil shale pack density and most of the organic material is removed by retorting, the spent shale volume nevertheless becomes substantially greater than the original volume. Thus spent shale as a waste product is expected to become an ever increasing problem as surface shale retorting operations continue to expand. The spent shale may be used for example in back filling of mine areas or other land reclamation operations. Other uses such are, for example, in road construction and as a filler in various reclamation projects.

The specific composition and properties of the spent shale depend on where it was obtained as well as on the retorting method by which it was caused to be spent. Generally speaking, oil shale consists of sedimentary inorganic material that contains complex organic materials of high molecular weight. Thermal decomposition is the primary means used to recover liquid products from the oil shale. Pyrolysis or retorting of the oil shale yields gaseous liquid and solid products. The liquid, which is produced by the pyrolysis, is in the form of vapor or mist as are the noncondensible hydrocarbon gases. The organic carbon which is not recovered as compounds in the gaseous or liquid product is converted to a coke-like deposit and becomes part of the spent shale. The spent shale, that remains after the initial retorting, is of little or no apparent economic value but is the material utilized in this invention.

Eastern U.S. shales for example contain significant amounts of organic carbon. Upon retorting however, only a small proportion of the organic carbon is converted to oil and the rest remains in the spent shale. It is important in the retorting of any oil shale to recover as much of the organic carbon in the form of oil as possible. However, in the case of Eastern shales it seems that the nature of the organic matter limits the amount of oil that may be produced. It has been suggested that the amount of oil that can be produced during retorting is limited because of the relatively large proportion of aromatic carbon in the organic matter. Thus any process that can be devised to improve this conversion and enhance the oil yield is desirable.

SUMMARY OF THE INVENTION

It has now been discovered that spent shale can provide significant amounts of additional oil by treating same with a mixture of methanol and water, removing the treating mixture and again retorting the treated spent shale. The use of waste or spent shale in this manner is therefore highly advantageous and, to applicant's best knowledge, unknown in the prior art heretofore.

DESCRIPTION OF SPECIFIC EMBODIMENTS

The novel process of the present invention wherein novel means for increasing the yield of oil from a given quantity shale is briefly and in general terms described below:

1. A given amount of spent shale is treated with a mixture of methanol and water under appropriate treatment conditions of time, temperature and pressure.

2. After the treatment, the methanol water mixture is removed from the spent shale by draining and desorption under moderate conditions.

3. After desorption the temperature of the treated shale under a suitable retort conditions is increased to from about 400°–600° C. The above process results in a yield of up to 20% more oil.

The temperature of the reactor may vary from about 225° to about 375° C. and preferably from about 250° to 350° C. The pressure of the reactor preferably should not exceed 2250 psi but it may vary from a low of about 900 to a high of about 2750 psi. Any suitable reactor may be used which can withstand the temperatures and the pressures and have sufficient volume for the process to be economic. Reaction or treatment time can vary depending upon the amount of and the specific nature of the spent shale and the other reaction variables. The methanol water ratio may vary from 10:1 to about 1:10 by volume; although a 1:1 ratio is preferred. The amount of shale will depend to a significant extent upon the method of contacting, for example, a fixed bed operation an ebolution operation or otherwise. Further, the ratio of shale to the methanol-water mixture for a specific run can be determined by imperical means but depends on the amount residual carbon on the spent shale.

Having generally described the novel process in accordance herewith the following is a more specific embodiment thereof.

EXAMPLE

Seventy-five grams of spent shale were treated with 50 cc of a mixture of methanol and water (1:1 by volume) at 335° C. The fixed bed reactor was equipped with a back-pressure regulator set to open at a pressure of 2250 psi.

After approximately two hours the methanol water mixture was drained and removed from the spent shale by desorption at about 180° C. and thereafter the temperature of the reaction zone was increased to about 490° C. thereby producing about 20% more oil than was obtained in the original retorting or pyrolysis. The recovered methanol/water mixture was then processed for reuse herein or in other downstream processes.

Although the present invention has been described with preferred embodiments, it is to be understood that modifications and variations may be resorted to without departing from the spirit and scope of this invention, as those skilled in the art will readily understand. Such modifications and variations are considered to be within the purview and scope of the appended claims.

I claim:

1. A method for increasing the yield of liquid oil from spent shales comprising (1) treating a spent shale with a mixture of from about a 10:1 to about a 1:10 ratio by volume of methanol to water at a temperature of between about 225° and 350° C. at a pressure of from about 900 to about 2750 psi for from about 10 minutes to about four hours, (2) removing the methanol-water mixture and (3) retorting the treated spent shale, resulting in the recovery of from about 10% to 40% more oil from the spent shale than was obtained in the original retorting process.

2. The method of claim 1 wherein the methanol/water mixture after removal from the spent shale is processed for recycling or for use in suitable downstream processes.

3. The method of claim 1 wherein the spent shale is contacted with a 1:1 mixture of methanol and water at about 275° to 350° C. for about one to two hours at a pressure of about 1450 to 2250 psi.

4. The method of claim 1 wherein in Step 3 the temperature of said processed spent shale is increased to about 475° to 500° C.

* * * * *